US007713024B2

(12) United States Patent
Burdgick et al.

(10) Patent No.: US 7,713,024 B2
(45) Date of Patent: May 11, 2010

(54) BLING NOZZLE/CARRIER INTERFACE DESIGN FOR A STEAM TURBINE

(75) Inventors: Steven Sebastian Burdgick, Guilderland, NY (US); William Edward Adis, Scotia, NY (US)

(73) Assignee: General Electric Company, Schenectady, NY (US)

( * ) Notice: Subject to any disclaimer, the term of this patent is extended or adjusted under 35 U.S.C. 154(b) by 629 days.

(21) Appl. No.: 11/704,317

(22) Filed: Feb. 9, 2007

(65) Prior Publication Data

US 2008/0193283 A1 Aug. 14, 2008

(51) Int. Cl.
*F01D 1/02* (2006.01)

(52) U.S. Cl. ..... 415/191; 415/209.3; 415/211.2

(58) Field of Classification Search ..... 415/191, 415/199.5, 209.3, 211.2, 209.2
See application file for complete search history.

(56) References Cited

U.S. PATENT DOCUMENTS 3,843,279 A * 10/1974 Crossley et al. ..... 415/191
5,024,579 A * 6/1991 Groenendaal et al. ..... 415/108
5,192,190 A * 3/1993 Ferleger et al. ..... 415/191
5,681,142 A * 10/1997 Lewis ..... 415/119
2003/0123979 A1* 7/2003 Mohammed-Fakir et al. ..... 415/189
2004/0253095 A1* 12/2004 Sasaki et al. ..... 415/191
2006/0133928 A1* 6/2006 Bracken et al. ..... 415/173.4

OTHER PUBLICATIONS

U.S. Application of Burdgick; U.S. Appl. No. 11/508,170, filed Aug. 23, 2006.

* cited by examiner

*Primary Examiner*—Edward Look
*Assistant Examiner*—Jesse Prager
(74) *Attorney, Agent, or Firm*—Nixon & Vanderhye PC

(57) ABSTRACT

A bling nozzle/carrier interface design for a steam turbine is provided wherein there is limited contact between the carrier (casing, shell) to allow for ease of assembly. There is also limited contact in strategic locations to both reduce the roll, or downstream deflection, of the inner portion and to improve disassembly due to limited contact in areas where corrosion can occur.

15 Claims, 6 Drawing Sheets

BLING NOZZLE/CARRIER INTERFACE DESIGN FOR A STEAM TURBINE

BACKGROUND OF THE INVENTION

Steam turbine designs consist of static nozzle segments that direct the steam flow into rotating buckets that are connected to a rotor. In steam turbines, the nozzle construction is typically called a diaphragm stage. Typical diaphragm stages are constructed using one of two methods. The first method is a "band/ring" method that uses an assembly comprised of a plurality of airfoils contained in inner and outer bands and then that banded airfoil assembly is welded into inner (web) and outer rings. The second method involves welding airfoils directly to inner and outer rings using a fillet weld at the interface. The second method is typically used for larger airfoils, where access for creating the weld is possible.

However, there are drawbacks to using these methods. One drawback is the inherent weld distortion of both the flow path and the steam path sidewalls. In this regard, current methods of steam turbine nozzle construction consist of high heat input welds using significant amounts of metal filler or deep electron beam welds. This material and heat input causes the flow path to distort and the airfoils often need to be adjusted after welding and stress relief. The result of the distortion is turbine efficiency losses in the steam turbine flow path.

Other methods using single nozzle construction into rings still have welds and mechanical interfaces that are difficult to model and analyze. They also are not as robust to stress level due to the weld interface and interfaces between the nozzles. Another method is to put "hooks" on the nozzle and slide each nozzle into a circumferential groove in the carrier. This method is also difficult and time consuming to analyze using finite element methods for stresses. Additionally, the frequency analysis is not as robust due to in determinant and changing boundary conditions between the nozzles and the carrier.

Thus, in general, current methods of constructing nozzle diaphragms are costly and time consuming in both engineering and manufacturing and all of the current methods consist of some type of weld or mechanical interface between nozzle and rings.

"Bling" design nozzles are currently used very little in steam turbine design. A bling is basically an entire nozzle flow path that is machined out of two half rings with no welding or assembly features. The bling has many valuable design qualities. First, blings have much lower stress levels because there are no weld joints or mechanical discontinuities in the load path. Second, the airfoil tolerances can be greatly improved over welded techniques. Third, they are easier to design and have more determinant frequency characteristics. In this regard, the 3D modeling and finite element analysis of the stress and frequencies is simpler, quicker and more robust due to the simplicity of the design.

An issue with current bling constructions is the interface between the carrier and the bling. In most diaphragm designs there are "crush pins" or small spacers to keep a tight tolerance between the diaphragm and the casing in the axial direction. The spacers act to keep the diaphragm loaded in the aft direction against the steam face. This helps assembly and also aids in the removal of the diaphragm after years of operation. In this regard, after years of operation, corrosion occurs on the surfaces and if the diaphragm to casing interface is tight on both axial faces, then it would be very difficult to get the diaphragm out as it would tend to lock into place due to the corrosion. Blings also "roll" or deflect downstream more than the slid in nozzle design. Many diaphragms use only the crush pins on the lower half (usually 3) and the upper half has a larger gap to the front face. This at times allows the diaphragm upper half to unseat off the back face and allow debris to get behind the face and cause a leakage path.

BRIEF DESCRIPTION OF THE INVENTION

The present invention relates to an improved interface between the bling and carrier to improve the loading, sealing, and disassembly of the blings, while reducing downstream deflection.

Thus, the invention may be embodied in a turbine comprising: a turbine nozzle assembly having at least one stator airfoil and including an inner sidewall at a radially inner end of the stator airfoil and an outer sidewall structure at the radially outer end of said stator airfoil; and an outer ring carrier having a radially inwardly open groove; wherein said outer sidewall structure is configured to slideably engage said groove in a radial direction while being restricted from moving in an axial direction with respect thereto, a forward contact area between said outer sidewall structure and said outer ring carrier comprising a forward circumferential land defined on one of an aft facing surface of said groove and an upstream axial face of the outer sidewall structure, said forward circumferential land having a radial dimension substantially less than a radial dimension of said groove, and an aft contact area between said outer sidewall structure and said outer ring carrier comprising a aft circumferential land defined on one of a forward facing surface of said groove and a downstream axial face of the outer sidewall structure, said aft circumferential land having a radial dimension substantially less than the radial dimension of said groove.

The invention may also be embodied in a turbine comprising: a turbine nozzle assembly having at least one stator airfoil and including an inner sidewall at a radially inner end of the stator airfoil and an outer sidewall structure at the radially outer end of said stator airfoil; and an outer ring carrier having a radially inwardly open groove; wherein said outer sidewall structure is configured to slideably engage said groove in a radial direction while being restricted from moving in an axial direction with respect thereto, and a forward interface between said groove and said outer sidewall structure being constructed and arranged for contact therebetween solely adjacent a radially outer end wall of said groove and the aft interface between said groove and said outer sidewall structure being constructed and arranged for contact solely adjacent a radially inner portion of said groove, remote from said radially outer end wall of said groove, whereby loading, sealing, and disassembly of the nozzle assembly with to the outer ring carrier, while reducing downstream deflection of the nozzle assembly.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

As noted above, with the bling nozzle design, the airfoil shapes are cut into two 180° rings to form the bling stage. This removes the mechanical fits and welded part of the fabrication, solving the issues mentioned above. The invention relates in particular to an improved interface design between the bling outer ring and the carrier. The design serves several purposes. It improves the assembly by allowing relief in appropriate areas to aid placement of the bling into the casing. Moreover, it improves the future disassembly after years of corrosion occurs between the bling and casing interface. It also reduces the ability of the bling to deflect downstream due to strategically placed contact areas. Further, it improves the contact pressure between the bling and the casing, thus improving steam face sealing.

Figure 1:
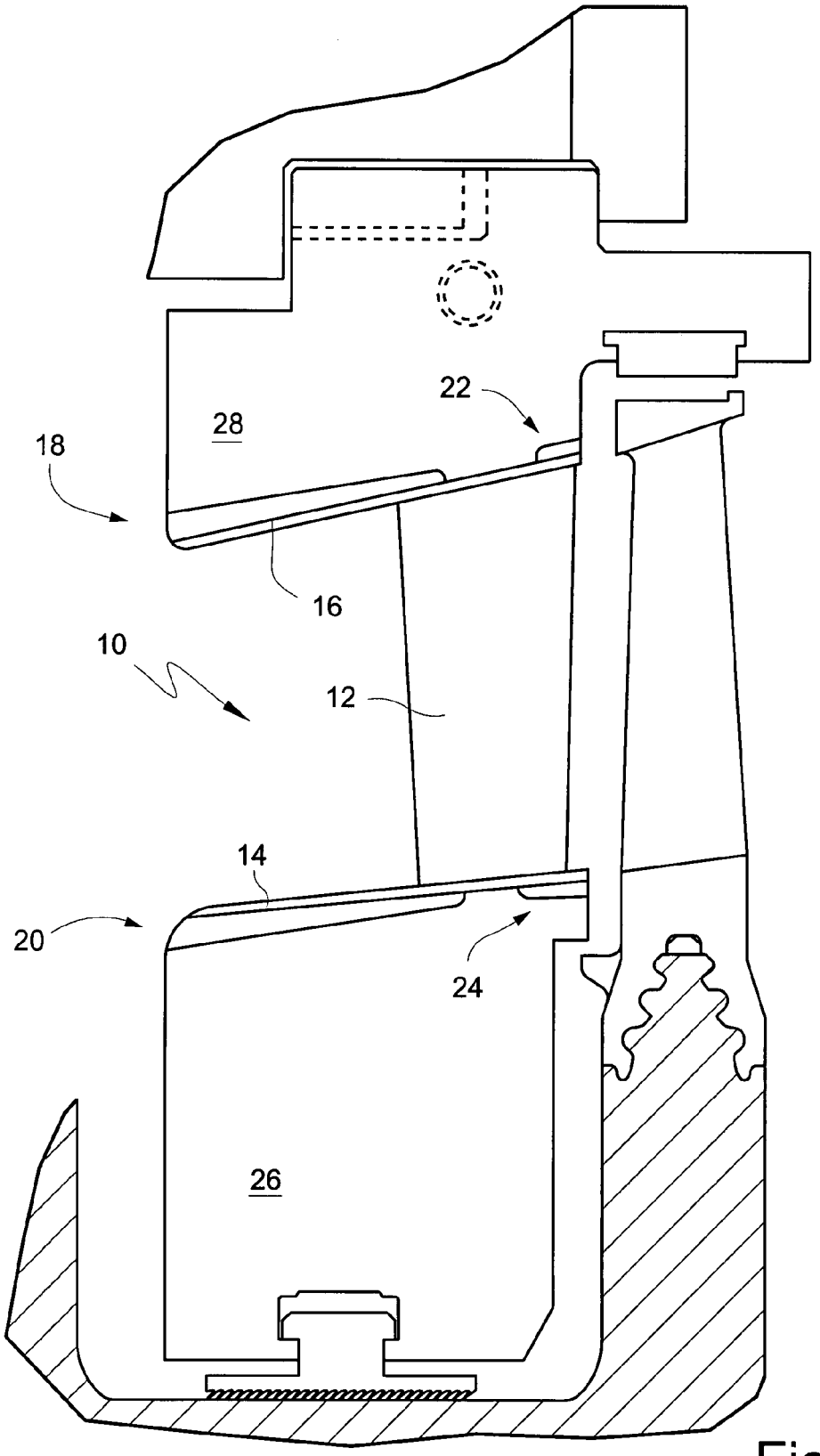
Fig. 1 PRIOR ART
FIG. 1 is a schematic elevational view of a conventional stage having a nozzle diaphragm formed using the band/ring method.

FIG. 1 shows the traditional construction of an impulse type turbine stage that uses partition, bands and rings welded into an assembly. More specifically, this traditional construction uses a diaphragm assembly 10 comprised of a plurality of airfoils 12 contained in inner and outer bands 14, 16 that are welded as at 18, 20, 22, 24 into an inner ring (web) 26 and an outer ring 28.

Figure 2:
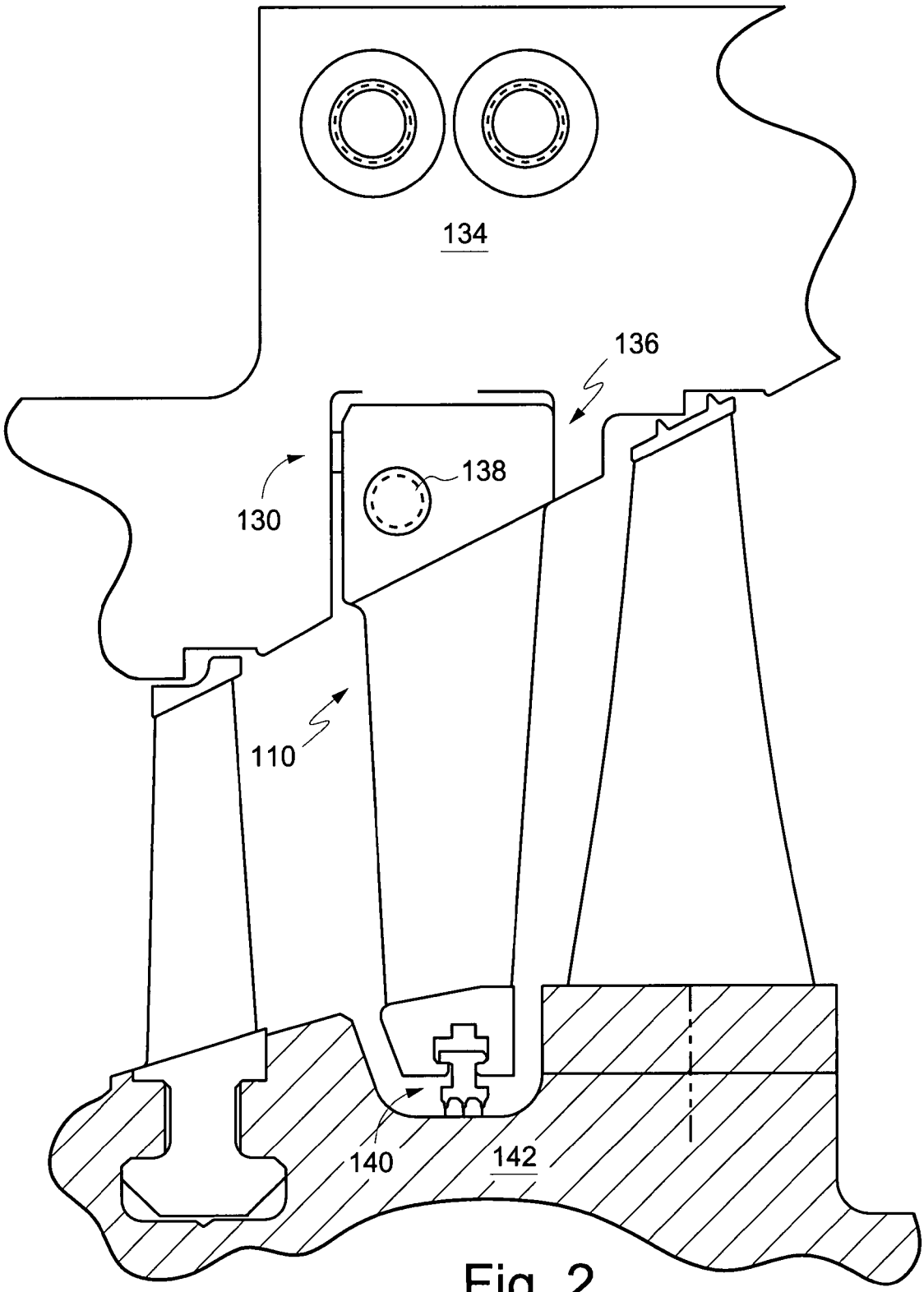
Fig. 2 PRIOR ART
FIG. 2 is a schematic elevational view of a conventional stage having a nozzle diaphragm formed using the bling type construction.

FIG. 2 shows the traditional bling construction. More specifically, this traditional bling construction uses a crush pin or small spacer 130 to keep a tight tolerance between the diaphragm 110 and casing 134 in the axial direction as shown at the steam face or axial contact face 136. As noted above, this helps assembly and also aids in the removal of the diaphragm after years of operation. Also illustrated are a horizontal joint bolt hole 138 and the interpacking seal 140 disposed at the interface between the bling 110 and the rotor 142.

As noted above, in general this invention relates to the features of the mechanical interface between a bling-type nozzle and the carrier (shell or casing) it is assembled into. The key to the design is the strategic placement of interfacing features with the shell and the removal of "crush pins" from the design. The first interface feature is a forward (or upstream) outer contact area defined, e.g., by an undercut (recess) on the casing side. This relief on the casing side allows for a small contact area that only engages once the bling is almost all the way into the casing groove. This allows for ease of assembly. Also, the disassembly is improved because the contact is very small and disengages as soon as the bling is slightly lifted.

The aft face, or steam contact face also has a very small contact area. Placing the recess on the bling in this situation allows for quick disengagement from the casing groove when disassembling the hardware. This also reduces the corrosion issue to only a small circumferential land to reduce the possibility of "sticking" or frozen joint when disassembling the hardware several years later. One other major benefit of this small circumferential aft land is that it helps concentrate the axial load of the bling in a small area. This in turn reduces the leakage across the steam face.

Another major benefit, or improvement, of this design over typical straight walls, crush pins and larger forward face gap, is the ability of this configuration to limit the deflection of the bling. When the bling is under steam path loading it wants to default downstream at the inner ring area due to the aerodynamic loads (pressure) on the airfoil. Designs that use hooks on the nozzles, when slid into a carrier groove, have very limited deflection down steam due to the hook interface. When putting a bling in the groove, part of the beneficial load path is gone to reduce deflection. The configuration of this design, in the illustrated example embodiments, has the forward land outboard and inner land inboard. The couple, having a relatively tight gap at the forward interface, limits the ability of the part to roll within the groove. The separation of these two faces allow for the load couple to react out part of the bling downstream deflection.

If the entire face was straight with a tight gap then there may be a significant issue with corrosion causing the parts to get "frozen" in place making disassembly difficult, if not impossible without destroying the hardware. If the entire faces were straight and the forward had a large gap and crush pin, as in the structure illustrated in FIG. 2, then there is no ability to limit the deflection (rolling) of the bling.

Figure 3:
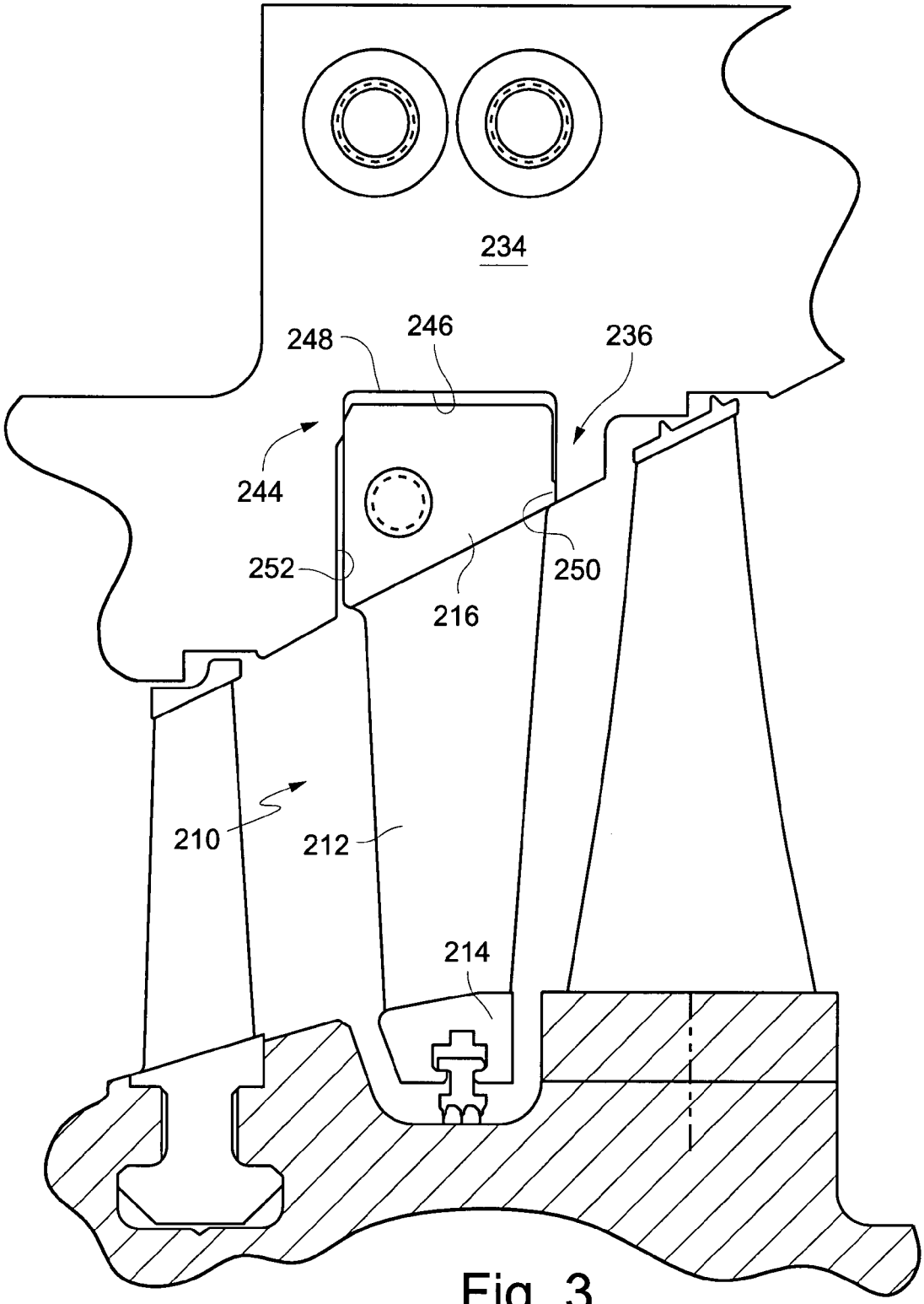
FIG. 3 is a schematic elevational view of a bling nozzle/carrier interface design according to a first example embodiment of the invention.
Figure 4:
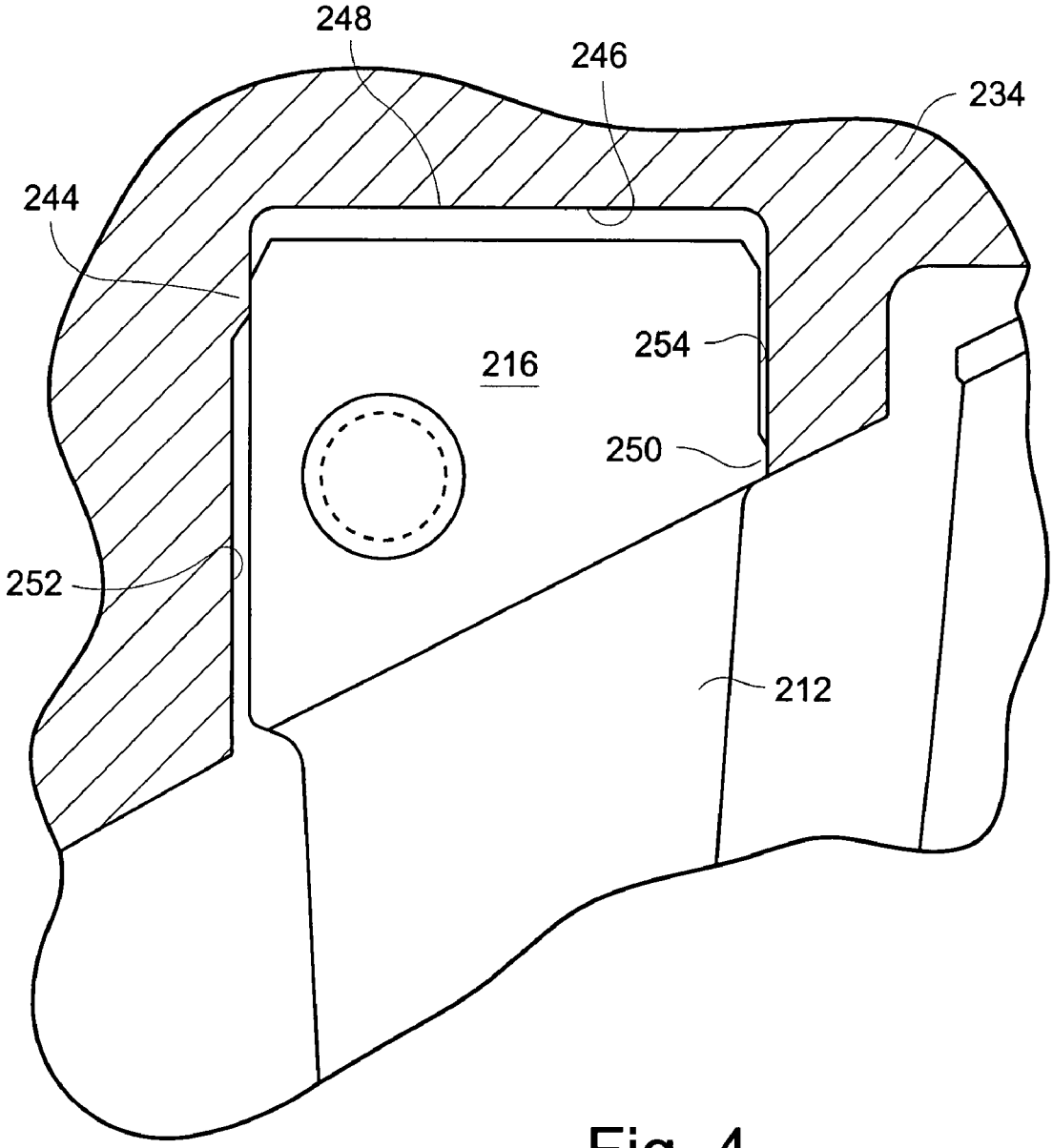
FIG. 4 is an enlarged, schematic elevational view of the bling/carrier interface face of FIG. 3.

FIGS. 3 and 4 illustrate an example embodiment of the invention wherein, rather than providing a crush pin disposed between the bling 210 and the casing or shell 234, a small circumferential land 244 is defined in the carrier. More specifically, the bling is comprised of airfoil(s) 212 and inner and outer side walls 214,216. In the embodiment of FIGS. 3 and 4, the outer side wall is received in a circumferentially extending groove 246 of the casing or shell 234. A small circumferential land 244 is defined as an axial contact face along the upstream side of the groove 246 adjacent the end wall 248 of the groove, thus providing for limited contact between the carrier 234 (casing, shell) to both reduce downstream deflection (roll), and for ease of assembly because it is provided in lieu of a local standoff or crush pin 130.

The steam face 236 also provides for limited contact as compared, for example, to the bling construction of FIG. 2. More specifically, as illustrated, a small circumferential land 250 is provided on the downstream axial face of the outer side wall 216 for engaging the casing or shell 234. In this example embodiment, the small circumferential land 244 of the casing groove 246 and the small circumferential steam face land 250 are defined by forming a circumferential recess 252 in the casing or shell 234 and by machining the bling 210 to create a circumferential recess 254 radially outside the steam face land 250.

Figure 5:
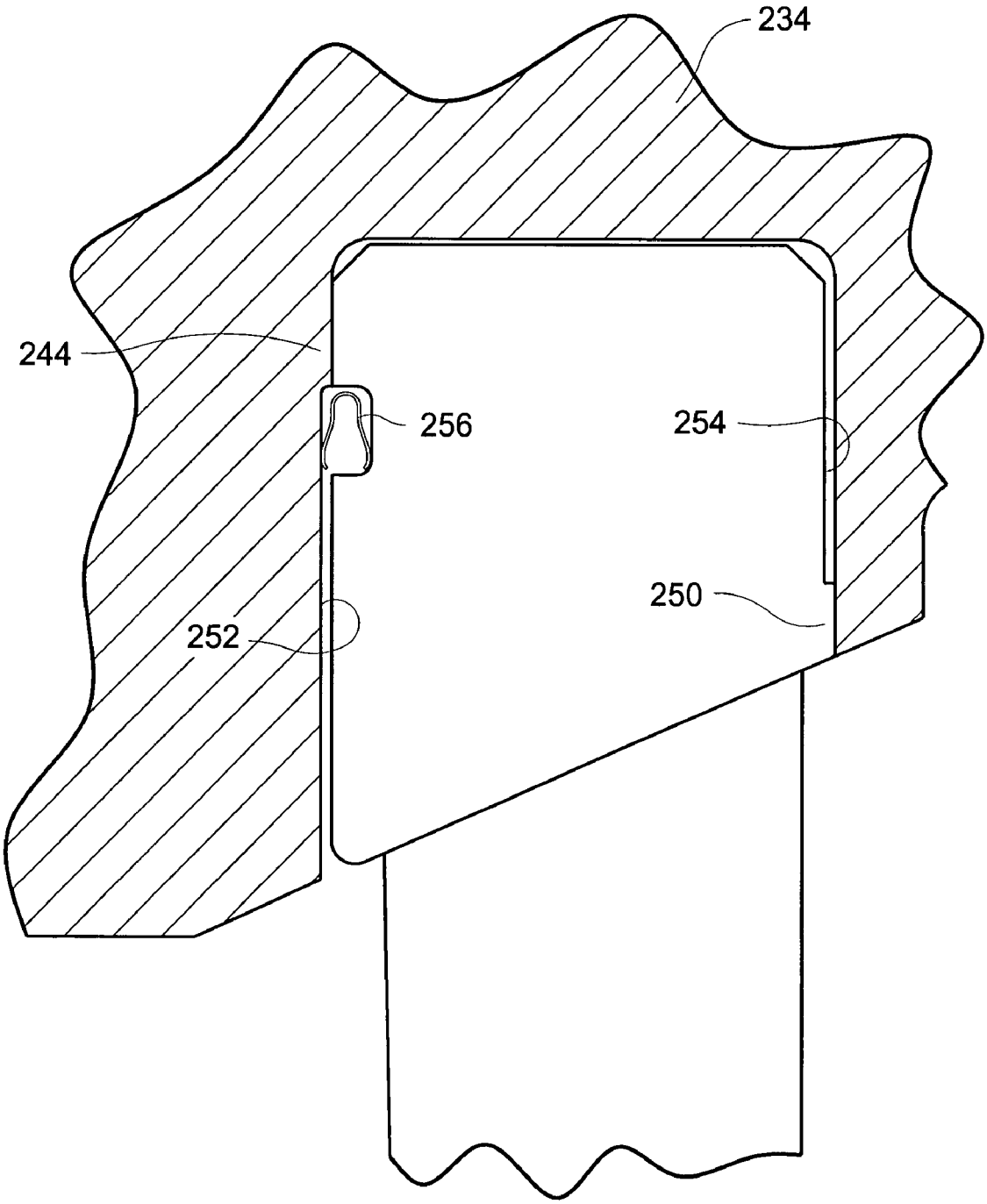
FIG. 5 is an enlarged, schematic elevational view of the bling/carrier interface with a forward seal according to another example embodiment of the invention.

FIG. 5 is a schematic illustration similar to FIG. 4 but illustrating the incorporation of a V or W seal 256 between the nozzle carrier 234 and bling outer ring 216. A "C" seal may be also used. The seal is not possible in most cases in the traditional designs as the forward part of the diaphragm, where it met with the casing, had a large gap and was of larger tolerance because of the provision of the crush pin. Now that the gap is held to tighter tolerances, and is a continuous surface, it is possible for a seal to be incorporated that is pressure activated or spring loaded while using the bling design.

Figure 6:
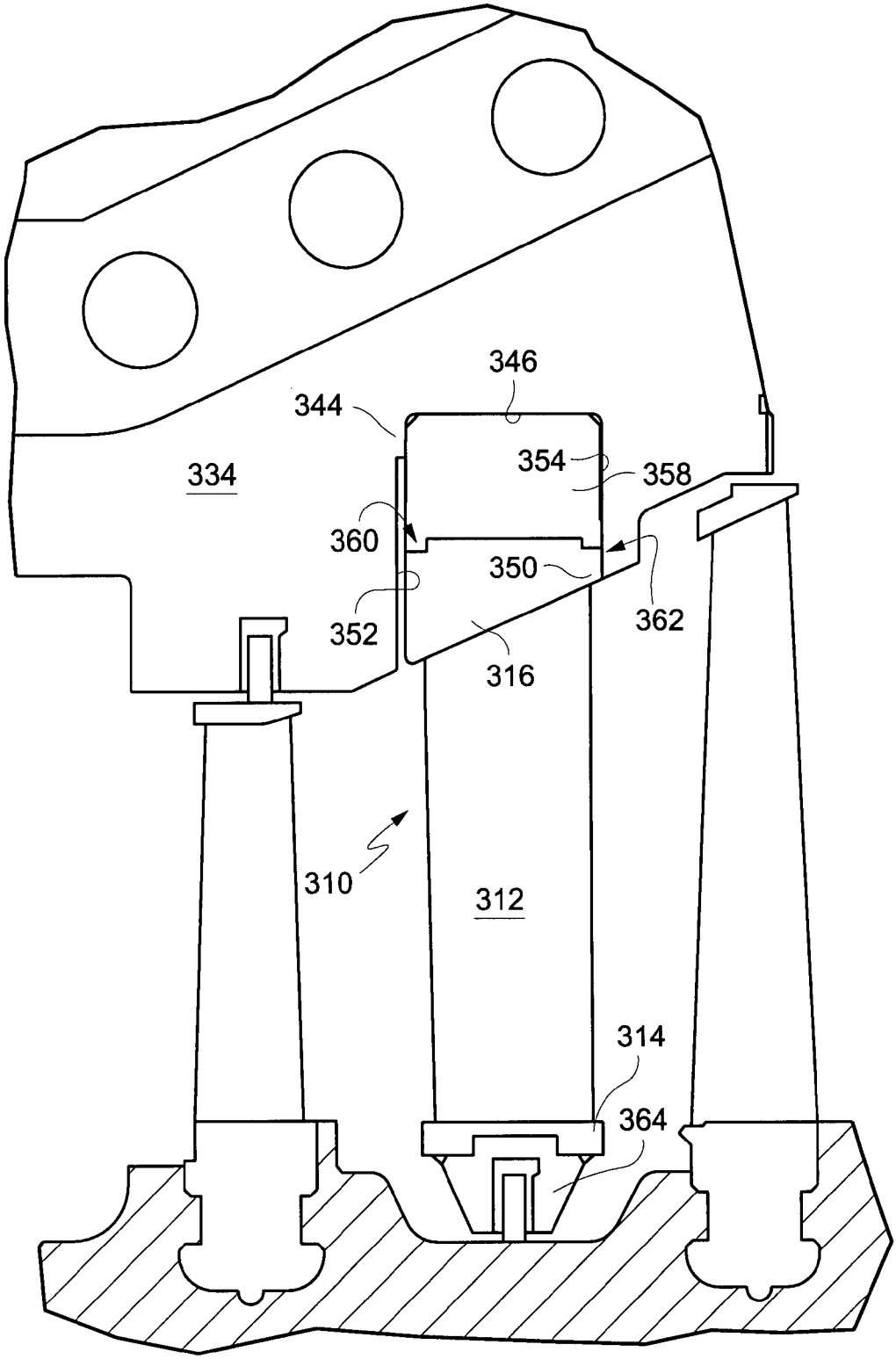
FIG. 6 is a schematic elevational view of a singlet construction according to yet another example embodiment of the invention.

The ring/carrier interface proposed in the embodiments of FIGS. 3-5, can also be applied to a "singlet" construction as illustrated in FIG. 6. This is a single nozzle 310 with its inner and outer side wall 314, 316 machined along with the airfoil 312. The singlet nozzle outer wall 316 is then welded to a solid outer ring 358 using small axial welds forward 360 and aft 362 as low heat welds to resemble a bling configuration. The assembly of the singlet nozzle and outer ring is then seated into a corresponding groove 346 of the nozzle carrier 334. The nozzle assembly (outer ring 358 and nozzles welded thereto) are not welded to the carrier. The nozzle assembly can move radially in the carrier groove. As in the embodiment of FIGS. 3 and 4, a small circumferential land 344 is defined by recessing the casing groove 346 circumferentially as at 352 on the upstream side of the nozzle assembly and by defining a small circumferential steam face land 350 by recess machining 354 of the solid ring 358 on the downstream side of the nozzle assembly.

The mechanical features of the interface between the singlet and the outer ring are used as an assembly and alignment feature and allow for improved reliability and risk abatement. In this regard, the mechanical lock between the ring 358 and nozzles 310 means that in the event of failure of an airfoil, the rings and nozzles cannot go downstream as there is a mechanical interface preventing the assembly from failing due to the pressure. Additionally, the mechanical lock serves the purpose of a pre-determined and repeatable weld stop. In this regard, the weld beam (assuming an EB weld) would stop when it hits the radial interlock interface. A further advantage of the FIG. 6 embodiment is that the radially outerface of the nozzle outer side wall 316 is configured as a flat end instead of a more costly circumferential cut end. The example embodiment of FIG. 6 has an inner ring 364 that is mechanically locked and braised or welded to the nozzle inner side wall 314 or simply mechanically locked to the nozzle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a turbine nozzle assembly having at least one stator airfoil and including an inner sidewall at a radially inner end of the stator airfoil and an outer sidewall structure at the radially outer end of said stator airfoil; and an outer ring carrier having a radially inwardly open groove; wherein said outer sidewall structure is configured to slideably engage said groove in a radial direction while being restricted from moving in an axial direction with respect thereto, a forward contact area between said outer sidewall structure and said outer ring carrier comprising a forward circumferential land defined on an upstream, aft facing surface of said groove, adjacent a radially outer end wall of said groove, said forward circumferential land having an axial surface defined in a radial plane that is disposed aft of and axially spaced from a remainder of the upstream, aft facing surface of said groove, said forward circumferential land having a radial dimension substantially less than a radial dimension of said groove, and an aft contact area between said outer sidewall structure and said outer ring carrier comprising an aft circumferential land defined on one of a downstream, forward facing surface of said groove and a downstream axial face of the outer sidewall structure, said aft circumferential land being disposed adjacent a radially inner portion of said groove, remote from the radially outer end wall of said groove, said aft circumferential land having a radial dimension substantially less than the radial dimension of said groove wherein said aft circumferential land is defined on the downstream axial face of the outer sidewall structure.

2. A turbine as in claim 1, wherein said forward circumferential land is defined by a recess formed in said outer casing.

3. A turbine as in claim 1, wherein the aft circumferential land is defined by a recess machined in said outer sidewall structure.

4. A turbine as in claim 3, wherein said aft circumferential land is disposed to engage said radially inner portion of said groove, remote from said radially outer end wall of said groove.

5. A turbine as in claim 1, wherein said outer sidewall structure comprises an outer sidewall segment welded to an outer ring that is received in said groove with said outer sidewall.

6. A turbine as in claim 5, wherein said outer sidewall segment has a flat radially outer face that engages a flat radially inner face of said outer ring.

7. A turbine as in claim 5, wherein said outer ring extends part circumferentially and is welded to a plurality of said outer sidewall segments.

8. A turbine as in claim 1, further comprising a seal between the aft facing surface of said groove and the upstream face of the outer sidewall structure.

9. A turbine as in claim 8, wherein said seal is a V or W seal.

10. A turbine comprising:

a turbine nozzle assembly having at least one stator airfoil and including an inner sidewall at a radially inner end of the stator airfoil and an outer sidewall structure at the radially outer end of said stator airfoil; and an outer ring carrier having a radially inwardly open groove; wherein said outer sidewall structure is configured to slideably engage said groove in a radial direction while being restricted from moving in an axial direction with respect thereto, and a forward interface between said groove and said outer sidewall structure being constructed and arranged for contact therebetween solely adjacent a radially outer end wall of said groove and an aft interface between said groove and said outer sidewall structure being constructed and arranged for contact solely adjacent a radially inner portion of said groove, remote from said radially outer end wall of said groove, whereby loading, sealing, and disassembly of the nozzle assembly to the outer ring carrier is facilitated, while reducing downstream deflection of the nozzle assembly, wherein said forward interface comprises a forward circumferential land defined on an upstream, aft facing surface of said groove, adjacent a radially outer end wall of said groove, said forward circumferential land having an axial surface defined in a radial plane that is disposed aft of and axially spaced from a remainder of the upstream, aft facing surface of said groove, said forward circumferential land having a radial dimension substantially less than a radial dimension of said groove, and wherein said aft interface comprises an aft circumferential land defined on one of a downstream, forward facing surface of said groove and a downstream axial face of the outer sidewall structure, said aft circumferential land being disposed adjacent a radially inner portion of said groove, remote from the radially outer end wall of said groove, said aft circumferential land having a radial dimension substantially less than the radial dimension of said groove wherein said aft circumferential land is defined on the downstream axial face of the outer sidewall structure.

11. A turbine as in claim 10, wherein said forward circumferential land is defined by a recess formed in said outer casing.

12. A turbine as in claim 10, wherein the aft circumferential land is defined by a recess machined in said outer sidewall structure, said aft circumferential land being disposed to engage the radially inner portion of said groove, remote from the radially outer end wall of said groove.

13. A turbine as in claim 10, wherein said outer sidewall structure comprises an outer sidewall segment welded to an outer ring that is received in said groove with said outer sidewall.

14. A turbine as in claim 13, wherein said outer ring extends part circumferentially and is welded to a plurality of said outer sidewall segments.

15. A turbine as in claim 10, further comprising a seal between an aft facing surface of said groove and an upstream face of the outer sidewall structure.

* * * * *